US006186032B1

(12) United States Patent
Raines

(10) Patent No.: US 6,186,032 B1
(45) Date of Patent: Feb. 13, 2001

(54) WRENCH

(76) Inventor: Carl F. Raines, Rte. 2 Box 305, Lynchburg, VA (US) 24501

( * ) Notice: Under 35 U.S.C. 154(b), the term of this patent shall be extended for 0 days.

(21) Appl. No.: 09/137,047

(22) Filed: Aug. 20, 1998

(51) Int. Cl.[7] ..... B25B 13/02
(52) U.S. Cl. ..... 81/119; 81/186
(58) Field of Search ..... 81/119, 186

(56) References Cited

U.S. PATENT DOCUMENTS 922,258 * 5/1909 Caven ..... 81/119

FOREIGN PATENT DOCUMENTS

746310 * 3/1933 (FR) ..... 81/119
1104189 * 6/1955 (FR) ..... 81/119
1082 * of 1915 (GB) ..... 81/119
8217261 * 1/1984 (GB) ..... 81/119

* cited by examiner

*Primary Examiner*—David A. Scherbel
*Assistant Examiner*—Daniel Shanley

(57) ABSTRACT

A new wrench for holding a nut in the head end when threading and unthreading the nut from a threaded object such as a threaded bolt. The inventive device includes a handle with a head end coupled to the handle. The head end has a first and second faces, and inner and outer side surfaces. The inner side surface of the head end defines an opening through the head end between the first and second faces of the head end. The head end also has a supporting flange extending radially inwards around the inner side surface of the head end. The head end has a break therethrough extending between the inner and outer side surfaces of the head end. The break also extends through an adjacent portion of the supporting flange.

1 Claim, 2 Drawing Sheets

FIG. 4
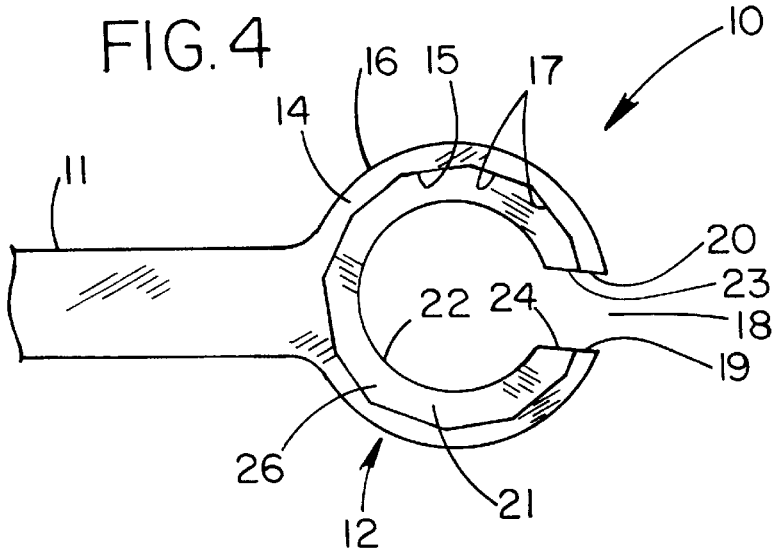
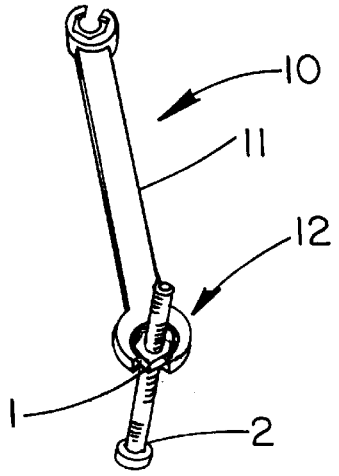
FIG. 6
FIG. 5
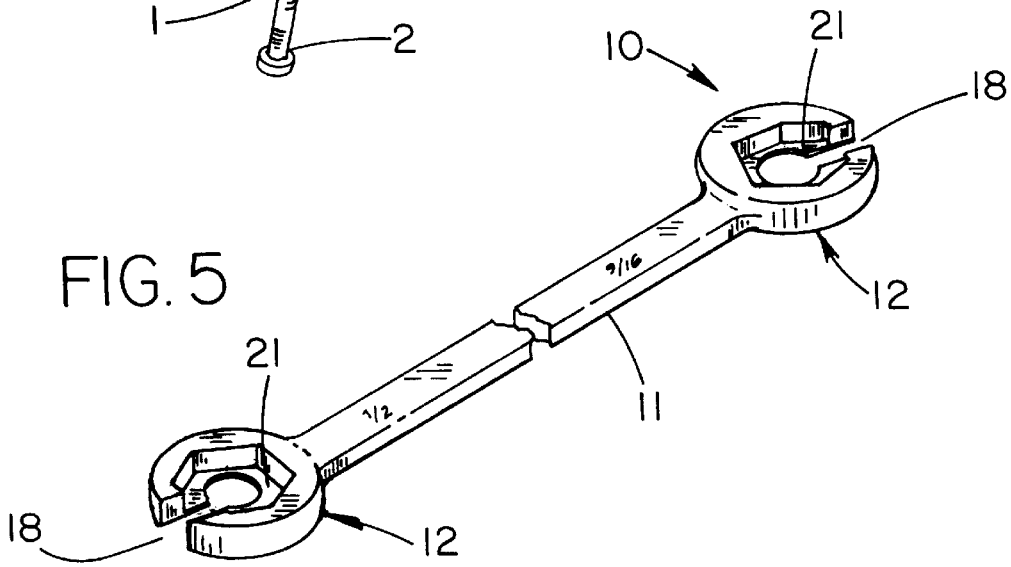

WRENCH

BACKGROUND OF THE INVENTION

1. Field of the Invention

The present invention relates to wrenches, in particular open ended wrenches and more particularly pertains to a new wrench for holding a nut in the head end when threading and unthreading the nut from a threaded object such as a threaded bolt.

2. Description of the Prior Art

The use of wrenches, in particular open ended wrenches is known in the prior art. More specifically, wrenches, in particular open ended wrenches heretofore devised and utilized are known to consist basically of familiar, expected and obvious structural configurations, notwithstanding the myriad of designs encompassed by the crowded prior art which have been developed for the fulfillment of countless objectives and requirements.

Known prior art wrenches, in particular open ended wrenches include U.S. Pat. No. 4,738,168; U.S. Pat. No. 4,406,188; U.S. Pat. No. 4,058,0323; U.S. Pat. No. 4,570,513; U.S. Pat. No. Des. 272,036; and U.S. Pat. No. Des. 309,411.

While these devices fulfill their respective, particular objectives and requirements, the aforementioned patents do not disclose a new wrench. The inventive device includes a handle with a head end coupled to the handle. The head end has a first and second faces, and inner and outer side surfaces. The inner side surface of the head end defines an opening through the head end between the first and second faces of the head end. The head end also has a supporting flange extending radially inwards around the inner side surface of the head end. The head end has a break therethrough extending between the inner and outer side surfaces of the head end. The break also extends through an adjacent portion of the supporting flange.

In these respects, the wrench according to the present invention substantially departs from the conventional concepts and designs of the prior art, and in so doing provides an apparatus primarily developed for the purpose of holding a nut in the head end when threading and unthreading the nut from a threaded object such as a threaded bolt.

SUMMARY OF THE INVENTION

In view of the foregoing disadvantages inherent in the known types of wrenches, in particular open ended wrenches now present in the prior art, the present invention provides a new wrench construction wherein the same can be utilized for holding a nut in the head end when threading and unthreading the nut from a threaded object such as a threaded bolt.

The general purpose of the present invention, which will be described subsequently in greater detail, is to provide a new wrench apparatus and method which has many of the advantages of the wrenches, in particular open ended wrenches mentioned heretofore and many novel features that result in a new wrench which is not anticipated, rendered obvious, suggested, or even implied by any of the prior art wrenches, in particular open ended wrenches, either alone or in any combination thereof.

To attain this, the present invention generally comprises a handle with a head end coupled to the handle. The head end has a first and second faces, and inner and outer side surfaces. The inner side surface of the head end defines an opening through the head end between the first and second faces of the head end. The head end also has a supporting flange extending radially inwards around the inner side surface of the head end. The head end has a break therethrough extending between the inner and outer side surfaces of the head end. The break also extends through an adjacent portion of the supporting flange.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrench apparatus and method which has many of the advantages of the wrenches, in particular open ended wrenches mentioned heretofore and many novel features that result in a new wrench which is not anticipated, rendered obvious, suggested, or even implied by any of the prior art wrenches, in particular open ended wrenches, either alone or in any combination thereof.

It is another object of the present invention to provide a new wrench which may be easily and efficiently manufactured and marketed.

It is a further object of the present invention to provide a new wrench which is of a durable and reliable construction.

An even further object of the present invention is to provide a new wrench which is susceptible of a low cost of manufacture with regard to both materials and labor, and which accordingly is then susceptible of low prices of sale to the consuming public, thereby making such wrench economically available to the buying public.

Still yet another object of the present invention is to provide a new wrench which provides in the apparatuses and methods of the prior art some of the advantages thereof, while simultaneously overcoming some of the disadvantages normally associated therewith.

Still another object of the present invention is to provide a new wrench for holding a nut in the head end when threading and unthreading the nut from a threaded object such as a threaded bolt.

Yet another object of the present invention is to provide a new wrench which includes a handle with a head end coupled to the handle. The head end has a first and second faces, and inner and outer side surfaces. The inner side surface of the head end defines an opening through the head end between the first and second faces of the head end. The head end also has a supporting flange extending radially inwards around the inner side surface of the head end. The head end has a break therethrough extending between the inner and outer side surfaces of the head end. The break also extends through an adjacent portion of the supporting flange.

Still yet another object of the present invention is to provide a new wrench that provides more stability and accurate alignment when unthreading a nut by preventing the head end of the wrench from slipping over the nut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic plan view of a dodecahedral embodiment of the present invention.

FIG. 5 is a schematic perspective view of a wrench of the present invention having a pair of opposite head ends.

FIG. 6 is a schematic perspective view of the present invention in use.

DESCRIPTION OF THE PREFERRED EMBODIMENT

Figure 1:
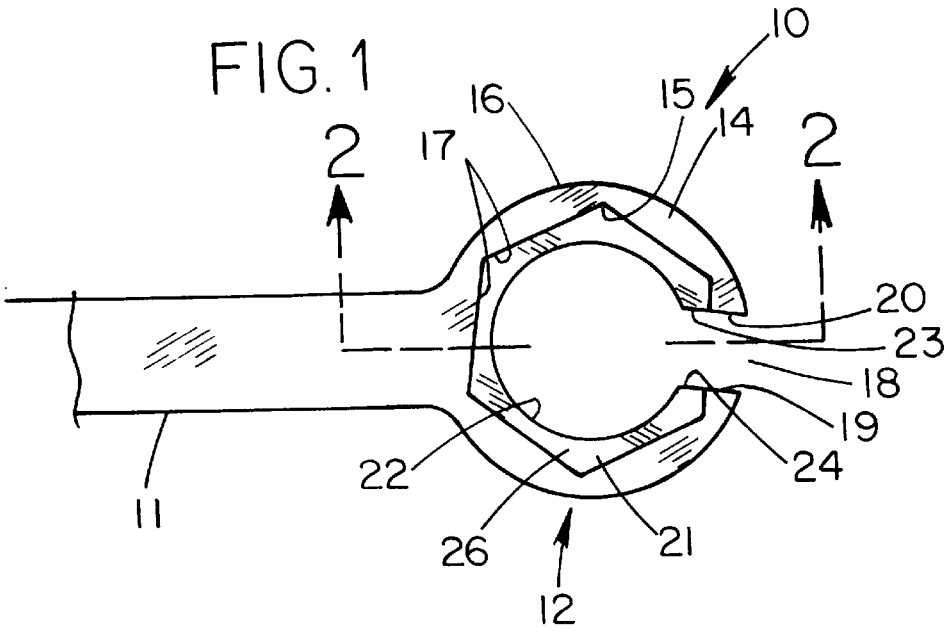
FIG. 1 is a schematic plan view of a new wrench according to the present invention.
Figure 2:
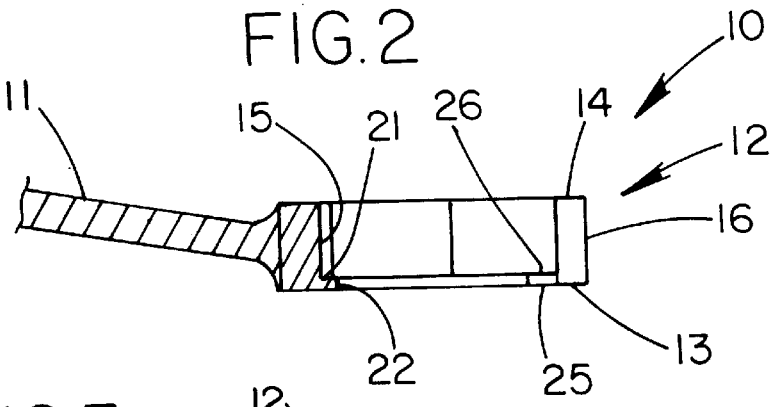
FIG. 2 is a schematic sectional view of the present invention taken from line 2—2 of FIG. 1 with the handle shaft extending at an obtuse angle from the head end.
Figure 3:
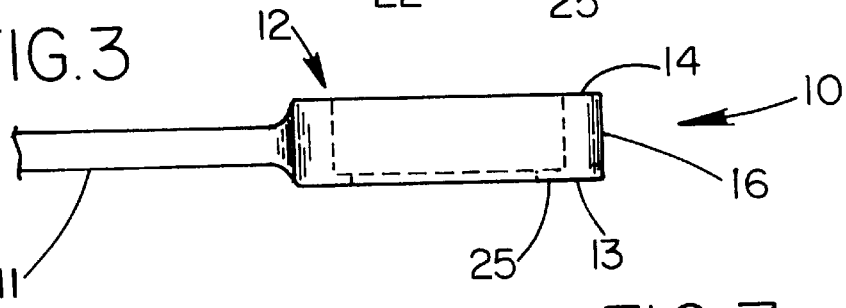
FIG. 3 is a schematic side view of the present invention with a straight extending handle shaft with respect to the head end.

With reference now to the drawings, and in particular to FIGS. 1 through 7 thereof, a new wrench embodying the principles and concepts of the present invention and generally designated by the reference numeral 10 will be described.

As best illustrated in FIGS. 1 through 7, the wrench 10 generally comprises a handle 11 with a head end 12 coupled to the handle. The head end 12 has a first and second faces, and inner and outer side surfaces 15,16. The inner side surface 15 of the head end 12 defines an opening through the head end 12 between the first and second faces 13,14 of the head end 12. The head end 12 also has a supporting flange 21 extending radially inwards around the inner side surface 15 of the head end 12. The head end 12 has a break 18 therethrough extending between the inner and outer side surfaces 15,16 of the head end 12. The break 18 also extends through an adjacent portion of the supporting flange 21.

In closer detail, the wrench preferably includes an elongate handle shaft 11 designed for grasping by a user. The head end 12 coupled to the handle shaft 11 and be extended at any angle with respect to the handle shaft 11. The head end 12 is designed for engaging a nut 1. The head end 12 has first and second faces 13,14, and inner and outer side surfaces 15,16. Preferably, the outer side surface 16 is generally cylindrical in shape although any appropriate shape may be used. The inner side surface 15 of the head end 12 defines an opening through the head end 12 between the first and second faces 13,14 of the head end 12. In use, the opening is designed for receiving a nut 1 therein. The inner side surface 15 is generally polygonal and has a plurality of wall portions 17. In one preferred embodiment, the inner side surface 15 is generally hexagonal and has six wall portions 17. In another preferred embodiment, the inner side surface 15 is generally dodecahedral and has twelve wall portions 17.

The head end 12 has a break 18 therethrough extending between the inner and outer side surfaces 15,16 of the head end 12. The break 18 extends through at least one of the wall portions 17 of the inner side surface 15. As illustrated in FIG. 1, the break 18 extends through one side wall in the hexagonal embodiment. As illustrated in FIG. 4, the break 18 preferably extends through two side walls 19,20 of the dodecahedral embodiment. The break 18 of the head end 12 forms a pair of spaced apart and opposing side walls 19,20 that face each other. The side walls 19,20 are spaced apart to permit slipping of the head end 12 around a threaded bolt 2. Preferably, the side walls 19,20 are spaced apart less than the width of one of the wall portions 17 in the hexagonal embodiment and less than two wall portions 17 in the dodecahedral embodiment. The side walls 19,20 also preferably lie in generally parallel planes.

Figure 7:
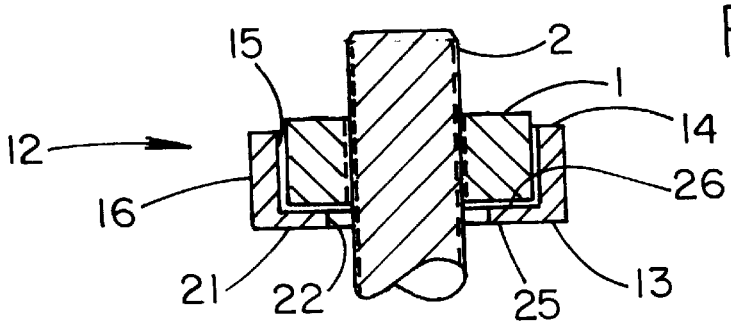
FIG. 7 is a schematic cross sectional view of the present invention in use.

The head end 12 has a supporting flange 21 extending radially inwards around the inner side surface 15 of the head end 12. The support flange is designed for supporting a nut 1 received in the opening formed by the inner side surface 15 of the head end 12 so that the supporting flange 21 abuts one of the faces of the nut 1 as illustrated in FIG. 7. The supporting flange 21 has an inner edge 22 which is preferably generally circular and defines an aperture for extending the threaded bolt 2 through on which the nut 1 is threaded on. The aperture has a diameter less than the width across diametrically opposite portions of the inner side surface 15 of the head end 12. The break 18 also extends through an adjacent portion of the supporting flange 21 so that the break 18 forms a pair of spaced apart and opposing end edges 23,24 on the supporting flange 21. The end edges 23,24 of the support flange face each other and are spaced apart generally the same distance the side walls 19,20 of the bread of the head end 12 are spaced apart. One of the end edges is preferably coplanar with one of the side walls while the other end edge is preferably coplanar with the other side wall.

The supporting flange 21 has first and second faces 25,26. Preferably, the first face 25 of the supporting flange 21 lie in a plane generally flush, that is, coplanar, with the plane the first face 13 of the head end 12 lies in. The second face 26 of the supporting flange 21 is positioned between the first and second faces 13,14 of the head end 12. The head end 12 has a thickness defined between the first and second faces 13,14 of the head end 12. The supporting flange 21 has a thickness defined between the first and second faces 25,26 of the supporting flange 21. The thickness of the head end 12 is greater than the thickness of the supporting flange 21. Preferably, the thickness of the supporting flange 21 is less than one-half the thickness of the head end 12. Ideally, the thickness of the supporting flange 21 is less than one-fourth the thickness of the head end 12.

In use, the wrench 10 looks like an open end wrench however, the wrench functions more like a box end wrench. In use, a threaded bolt 2 (or similar threaded structures such as lines, pipes, and tubing) is inserted into the opening of the head end 12 through the break 18 so that a nut 1 threaded on the bolt 2 is received in the opening. One face of the nut 1 abuts the second face 26 of the supporting flange 21 so that as the nut 1 is unthreaded off or threaded on the bolt 2, the supporting flange 21 helps hold the head end 12 in the proper position against the nut 1 and helps a user to more controlled removal and tightening of the nut 1 from the bolt 2. The supporting flange also allows the user to apply pressure against the nut 1 with the supporting flange 21 if necessary for the performed task.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrench, comprising:

a handle shaft;

pair of head ends coupled to opposing ends of said handle;

each of said head ends comprising:

said head end having a first and second faces, and inner and outer side surfaces;

said outer side surface being generally cylindrical in shape;

said inner side surface of said head end defining an opening through said head end between said first and second faces of said head end, said opening being adapted for receiving a nut therein;

said inner side surface being generally polygonal and having a plurality of wall portions;

said head end having a break therethrough extending between said inner and outer side surfaces of said head end, said break extending through at least one of said wall portions of said inner side surface;

said break of said head end forming a pair of spaced apart and opposing side walls facing each other, said side walls being spaced apart to permit slipping of said head end around a threaded bolt, wherein said side walls are spaced apart less than the width of one of said wall portions, said side walls lying in generally parallel planes;

said head end having a supporting flange extending radially inwards around said inner side surface of said head end, said support flange being adapted for supporting the nut in said opening formed by said side surface of said head end such that said supporting flange abuts a face of the nut;

said supporting flange having an inner edge, said inner edge of said supporting flange being generally circular and having a diameter, said inner edge of said supporting flange defining an aperture for extending the threaded bolt through;

said break extending through an adjacent portion of said supporting flange;

said break forming a pair of spaced apart and opposing end edges on said supporting flange, said end edges of said support flange facing each other, said end edges being spaced apart generally the same distance said side walls of said break of said head end are spaced apart, one of said end edges being coplanar with one of said side walls, another of said end edges being coplanar with another of said side walls;

said supporting flange having first and second faces, said first face of said supporting flange lying in a plane generally coplanar with a plane said first face of said head end lies in, said second face of said supporting flange being positioned between said first and second faces of said head end;

said head end having a thickness defined between said first and second faces of said head end;

said supporting flange having a thickness defined between said first and second faces of said supporting flange;

wherein said thickness of said head end is greater than said thickness of said supporting flange; and wherein said handle is angled away from a first plane of said first face of one of said head such that handle passes through a plane of the second face.

* * * * *